United States Patent [19]

Kurki

[11] Patent Number: 4,984,490

[45] Date of Patent: Jan. 15, 1991

[54] METHOD AND APPARATUS FOR ADJUSTING THE CUTTING KNIFE CLEARANCE IN SHEET CUTTERS

[75] Inventor: Jarmo Kurki, Karhula, Finland

[73] Assignee: Valmet-Ahlstrom, Inc., Karhula, Finland

[21] Appl. No.: 280,897

[22] Filed: Dec. 7, 1988

[30] Foreign Application Priority Data

Dec. 9, 1987 [FI] Finland ..... 875423

[51] Int. Cl.[5] ..... B26D 7/26

[52] U.S. Cl. ..... 83/13; 83/74; 83/349; 83/508

[58] Field of Search ..... 83/13, 74, 171, 349, 83/658, 674, 75, 508, 62, 62.1, 72, 522.23; 364/474.17, 474.18, 474.09

[56] References Cited

U.S. PATENT DOCUMENTS

| | | | |
|---|---|---|---|
| 3,186,275 | 6/1965 | Obenshain | 83/349 |
| 4,148,236 | 4/1979 | Holoyen et al. | 83/171 |
| 4,218,943 | 8/1980 | Osburg | 83/304 |
| 4,380,944 | 4/1983 | Gerber et al. | 83/74 |
| 4,426,897 | 1/1984 | Littleton | 83/349 |
| 4,478,119 | 10/1984 | Larson | 83/74 |
| 4,763,637 | 8/1988 | Mayer | 83/74 |

*Primary Examiner*—Hien H. Phan
*Assistant Examiner*—Scott A. Smith
*Attorney, Agent, or Firm*—Dellett, Smith-Hill and Bedell

[57] ABSTRACT

The invention is related to a method for adjusting the knife clearance in sheet cutters. In a sheet cutter, the web material is cut by means of a cutter drum (1) rotated by drive mechanism (4) and provided with cutting knives (2), and a counter knife (5) disposed in a knife support (6) and positioned at knife clearance distance from the moving cutting knives (2). In the method according to the invention, the cutting forces acting on the cutting knives of the sheet cutters, or their effect on the structure of the sheet cutter during its operation, are measured, and the information from the measurement is used as a command variable for the knife clearance. The command variable can be determined in several different ways, and according to one embodiment of the invention, it is determined by measuring the vibration level of the structure of the sheet cutter due to the cutting forces. The invention is also related to an apparatus for carrying out the method.

13 Claims, 4 Drawing Sheets

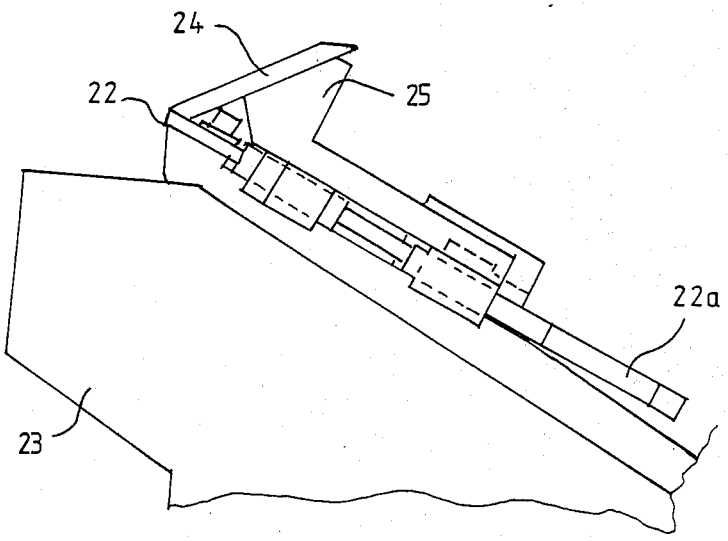
FIG. A 1
PRIOR ART
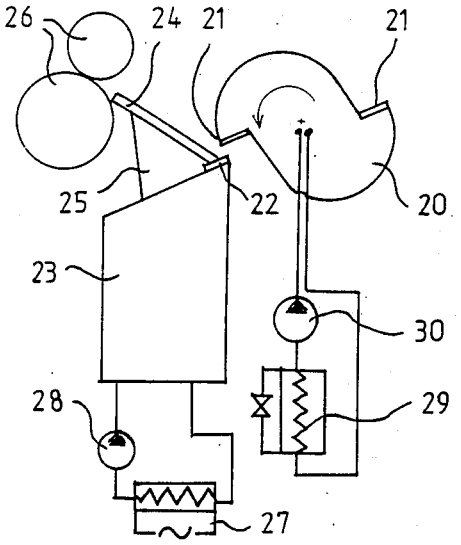
FIG. A 2
PRIOR ART

METHOD AND APPARATUS FOR ADJUSTING THE CUTTING KNIFE CLEARANCE IN SHEET CUTTERS

The present invention relates to sheet cutters used in pulp and paper industry, and more particularly, it relates to the cutting of web material into sheets and a method for adjusting the clearance between the cutting knives in sheet cutters.

More specifically, the invention relates to a method for adjusting the clearance between the cutting knives in sheet cutters, in which the web material is cut by means of a cutter drum rotated by drive means and provided with cutting knives, and a counter knife disposed in a knife support and positioned at knife clearance distance from the moving cutting knives.

The invention also relates to an apparatus for carrying out the method for adjusting the clearance between the cutting knives in sheet cutters which include a cutter drum rotated by drive means and provided with cutting knives, and a counter knife disposed in a knife support, the web material to be cut being arranged to be fed between the cutting knives and the counter knife so as to cut the web.

Several methods are previously known in pulp and paper industry for adjusting the cutting knives in sheet cutters during operation. One of the methods is of adjust the stationary counter knife by means of turnable adjusting screws so that deteriorated cutting or failure to cut can be corrected, either locally or more extensively. FIG. A1 illustrates this solution. FIG. A1 is a schematic side view of the attaching and adjusting system of the counter knife in a sheet cutter, in which the cutter drum with its cutting knife are left out of the drawing. In the previously known sheet cutter shown in FIG. A1, counter knife 22 is attached to knife support 23, which in turn has been attached to the frame structure of the sheet cutter not shown in the figure. Counter knife 22 is adjustably attached to counter knife support 23 by means of a plurality of adjusting screws **22*a* in a row across the width of the counter knife. Counter knife 22 is thus adjusted by adjusting screws 22*a* in the direction of the clearance between the cutting knives. The web to be cut moving over counter knife 22 is guided by guiding plate 24 supported by support 25**.

Another previously known adjusting method has been disclosed in U.S. Pat. No. 3 359 843. In the solution according to this publication, the knife clearance is adjusted so that the whole counter knife support is moved or bent. Also according to the solution disclosed in the publication, the position of the cutter drum can be altered in order to thus adjust the knife clearance.

The previously known systems described above are suitable for correcting widened clearances due to normal wear in knives. However, these previously known systems do not solve problems caused by e.g. production interruptions. When the cutter is started after a stoppage, the differencies in temperatures in the cutter are considerable. The cutter is at ambient temperature while the web material fed into the cutter may be at as much as 60° C. higher temperature. The conditions in the cutter are also not stable, when the running speed is altered and there is a momentary change in the temperature of the web material.

Attempts to solve the problem caused by the differences in temperatures, which have been described above, have been made by constructing various coolers, cooling loops or cylinders after the drying section. However, these solutions are expensive and they achieve relatively little. The temperature of the web to be cut rarely drops below +40° C. after these cooling systems. The consequence of the differences in temperature between various structures is often not only deterioration of the cutting ability or quality, but a far more serious problem, which is the knife clearance being reduced to zero, thus causing mechanical contact between the knives.

At the least, this causes a need for adjusting the cutter knife clearance, but a more serious consequence might be damage to the knives, which in that case would have to be replaced. If the damage to the knives should be extensive, other structures might also be damaged, and the ultimate consequence would be a long shutdown period.

To solve the problems described above, the previously known technique has developed a system illustrated schematically in FIG. A2. FIG. A2 is a schematic side view of a sheet cutter and its adjusting system according to previously known technique. The sheet cutter according to FIG. A2 comprises a cutter drum 20 provided with cutting knives 21.

Cutter drum 20 is arranged to rotate in the frame structure of the cutter. Counter knife 22 is attached to counter knife support 23 and the web to be cut, which is moving over the counter knife, is arranged to be guided by guiding plate 24, which is supported by support 25. The web material to be cut is fed into the cutter by feed rolls 26. The system according to FIG. A2 comprises thermostat controlled water circulation heating, which maintains cutter drum 20 and counter knife support 23 at a constant temperature. Counter knife support 2 is thus provided with piping, in which water heated by a first resistance heater 27 is being circulated by means of a first pump 28. Correspondingly, cutter drum 20 is provided with piping, in which water heated by a second thermostatcontrolled resistance heater 29 is circulated by means of a second pump 30. The temperature of the water circulated has been selected to keep the temperature of the structure higher than the temperature of the web to be fed into the cutter. This system has proved quite reliable in practice.

The system according to FIG. A2 does not remove or correct the fact that the clearance between the cutting knives in sheet cutters tends to alter due to normal wear in the knives. In order to correct the clearance between the knives, arrangements have to be made for mechanical adjustment of the knives from separate adjusting screws, or alternatively, raising the temperature in such a way that the thermal expansion in various directions decreases the knife clearance. The problem with the latter presents itself when the temperature of the web material approaching the cutter is very high. From this follows that the temperatures of the structures have to be kept at a high level. High temperatures make servicing the equipment more difficult to carry out. All previously known solutions described above are limited either to manual adjustment of the knife clearance in sheet cutters when the temperatures of the structures change, or to retaining the temperatures of the structures at a constant level. As the practical knife clearance is both small and narrow (ranging between 0.01–0.10 mm), the proper knife clearance from both technical and quality point of view is difficult and time-consuming to set and maintain. As the sheet cutter is often an integral and organic part of the drying section, any extra serciving and adjusting time means reducing the total production of the machine.

The object of the present invention is to improve the previously known solutions. To achieve this, the method according to the invention is characterized in that the cutting forces acting on the cutting knives of the sheet cutter, or their effect on the structure of the sheet cutter during operation of the sheet cutter are measured, and the readings are used as the command variable for the knife clearance.

The apparatus according to the invention is in its turn characterized in that the sheet cutter is provided with at least one sensor or corresponding means for measuring the forces acting on the cutting knives of the sheet cutters, or the effect of the cutting forces on the structure of the sheet cutter during its operation, processing and controlling means for the information from the sensor, and a continuous-action device for adjusting the knife clearance, which is arranged to maintain the desired clearance between the cutting knives of the sheet cutter using as command impulses the information from the sensor fed by the processing and control means.

The most outstanding advantage of the present invention compared with the previously known solutions is that, by the invention, both the changes in temperature at startup and the changes in the knife clearance due to normal wear, are controlled.

Further advantages and characteristics of the invention will be apparent from the following, detailed description of the invention.

In the following, the invention is described in detail with reference to the figures in the enclosed drawings:

FIGS. A1 and A2 are prior art cutting devices.

Figure 1:
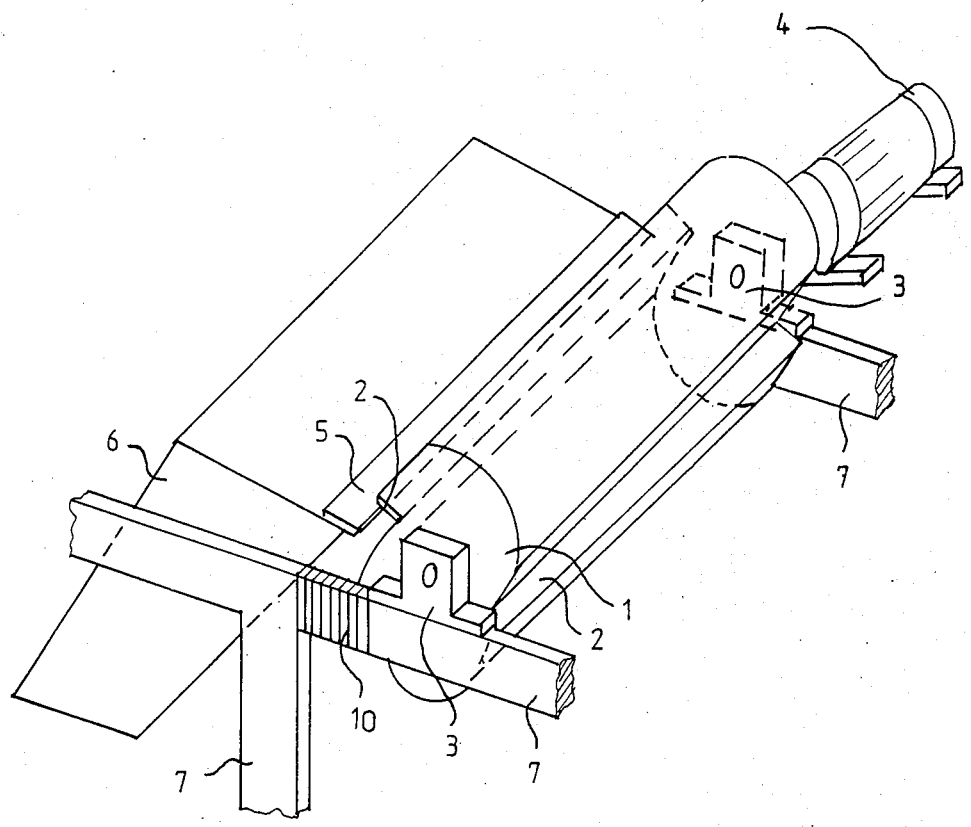
FIG. 1 is a schematic perspective view of a cross section of a sheet cutter provided with a rotating cutting knife and a counter knife.

FIG. 1 is a schematic perspective view of a cross section of a sheet cutter where the method and apparatus according to the invention are employed. The sheet cutter comprises a cutting drum 1 provided with cutting knives 2. Cutting drum 1 is rotatably mounted in bearings on a frame 7 by means of bearing housings 3. Cutting drum 1 is rotated by drive means 4, which can, according to FIG. 1, be directly mounted on the shaft of cutting drum 1, or alternatively, suitable power transmission means can be arranged between drive means 4 and the shaft of cutting drum 1.

Attached to sheet cutter frame 7 is a counter knife support 6, to which a counter knife 5 is in turn attached leaving a desired clearance between counter knife 5 and the knives 2 of the rotating cutting drum 1, which clearance is here called the knife clearance. The sheet cutter also comprises, as usual, a guiding plate with its support, not shown in the figure. FIG. 1 also shows a hatched area 10, hereafter called "measure section", this being the distance between bearing housings 3 of cutting drum 1 and cutter frame 7, and the points where counter knife support 6 and cutter frame 7 are attached to each other.

Figure 2:
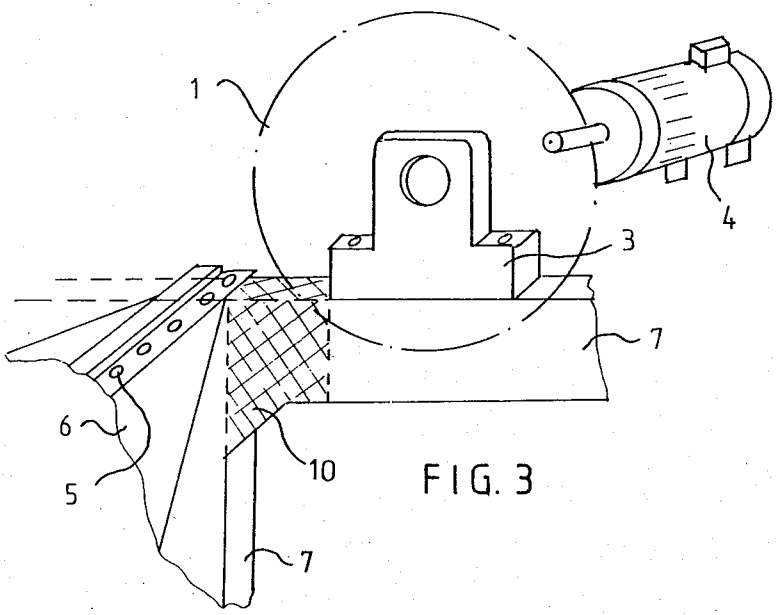
FIG. 2 is a schematic illustration of the cutting forces prevailing in a sheet cutter.

FIG. 2 is a schematic illustration of the cutting forces prevailing during the cutting process. FIG. 2 shows schematically a rotatable cutting drum 1 equipped with knives 2 and a counter knife 5 attached to a counter knife support 6. Reference $F_1$ and the arrow symbolizing it is a force component resisting the rotation of cutting drum 1, i.e. a force component tangential to the circle described by the rotating knives, in other words the main cutting force. Reference $F_2$ and the arrow symbolizing it is a force component attempting to spread apart from each other counter knife 5 and rotating knife 2, i.e. a force component in the direction of the radious of the circle described by rotating knife 2, or in other words, the spreading force. The spreading force $F_2$ is thus defined as being right-angled to the main cutting force $F_2$. During the cutting process, the main cutting force $F_1$ attempts to slow down the rotation speed of cutting drum 1 and the spreading force $F_2$ attempts to widen the gap between counter knife 5 and the rotating knife 2. The empirical research carried out both under laboratory conditions and in the field has shown that the knife clearance and the cutting forces on the hand and the knife clearance and the quality of cutting on the other hand are clearly dependent on each other. By cutting quality is meant a visual estimate of hown neat the cut is, and the rate of fiber knots based on the number of knots per a certain unit of pulp. Fiber knots are fibers tightly bonded to each other, which do not become separated in the pulp slushing process preceding paper making, but cause the so called fish-eye phenomenon in the end product. The consequence is bad printability and thus a product of inferior quality. The forming of fiber knots is typical of birchwood pulp, which contains hemicellulose. This phenomenon is of little consequence where soft wood pulp is concerned.

Figure 3:
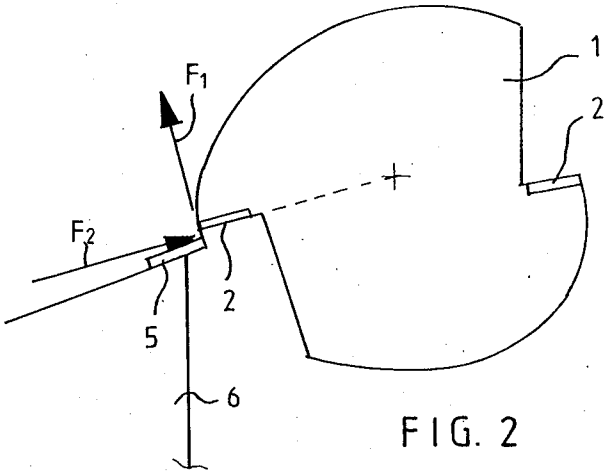
FIG. 3 is a partial and schematic perspective view of an arrangement according to the invention.

FIG. 3 is a schematic and partial perspective view of a sheet cutter, where reference numeral 1 refers to a cutting drum, the periphery of which is schematically shown as dash lines. Reference numeral 3 refers to one of the bearing housings by means of which the cutting drum is rotatably mounted on a frame 7 of the sheet cutter. Cutting drum 1 is rotated by means of drive means 4. Attached to frame 7 is also a counter knife support 6, whereto in turn counter knife 5 is attached. As described above, reference numeral 10 refers to a certain measure section, by which is meant the distance between cutting drum 1 and counter knife support 6. In the arrangement according to the invention, the knife clearance is set by adjusting the said measure section 10 or the distance between counter knife support 6 and cutting drum 1.

Measure section 10 may be adjusted by various means, but preferably by altering the temperature of measure section 10, as mechanical adjustment is often too inaccurate. The temperature of measure section 10 may be altered by various means and FIGS. 4 and 5 show two preferred embodiments.

Figure 4:
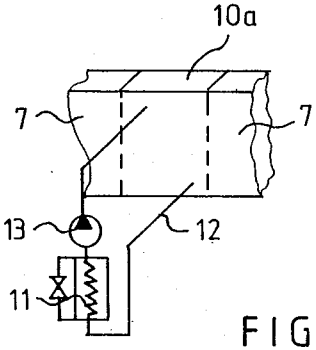
FIGS. 4 and 5 are schematic illustrations of various embodiments of the means associated with controlling the knife clearance.
Figure 5:
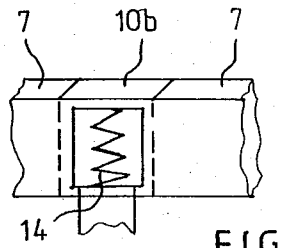

In FIG. 4 reference numeral **10*a* refers to the measure section. In the embodiment of FIG. 4, piping, a channel system, or the like, 12, is connected to measure section 10*a*, wherein a heatable medium, such as liquid, preferably water is circulated. Piping 12 is connected to a resistance heater 11, which is suitably controllable, for instance thermostat controlled in such a way that the temperature of the medium can be adjusted as desired. The medium is circulated in piping 12 by means of a pump 13. In the embodiment of FIG. 5, measure section 10*b* is fitted with a temperature controlled 14, e.g. electric resistance or the like, by means of which the temperature of measure section 10 can be adjusted. By raising the temperature of measure section 10, 10*a*, 10*b***, the knife clearance is increased, and correspondingly, by lowering the temperature the knife clearance is decreased.

Figure 6:
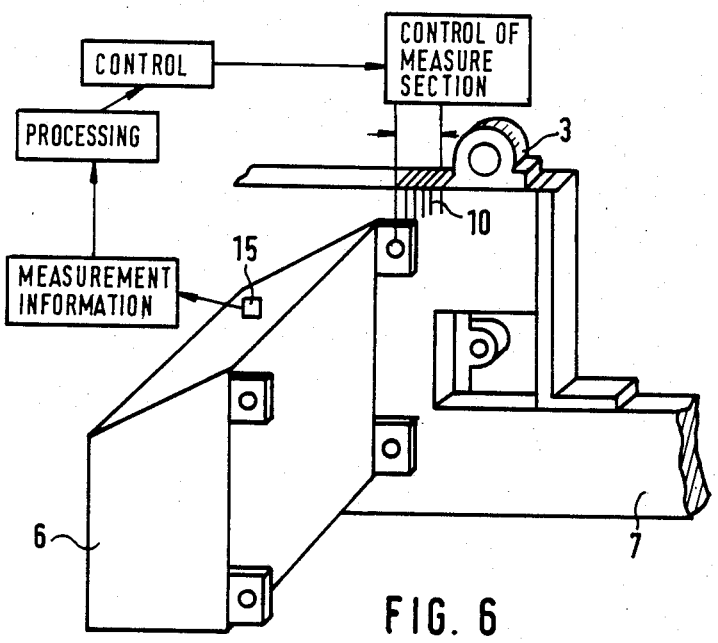
FIGS. 6 and 7 show an embodiment of the knife clearance adjustment according to the invention, FIG. 6 illustrating schematically the method of adjusting the clearance and FIG. 7 being a block diagram of the knife clearance adjusting method.
Figure 7:
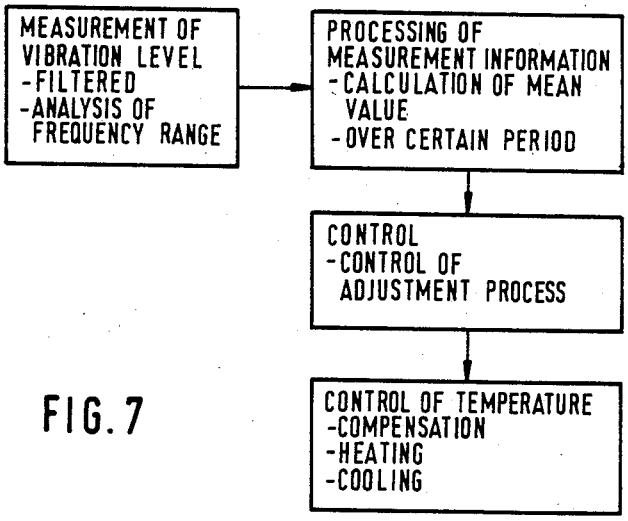

Cutting forces $F_1$ and $F_2$ cause vibrations in the sheet cutter frame. The vibration level of the frame is proportional to the cutting forces $F_1$ and $F_2$, so that the magnitude of these forces can be directly calculated from the frequency range of the vibrations. The basis for the adjustment system according to one embodiment of the invention is the vibration level, according to which the knife clearance is adjusted. This embodiment of the invention is illustrated in FIGS. 6 and 7. In this embodiment, a sensor 15 is disposed in the counter knife support 6 for measuring the frequency or acceleration. The sensor 15 is shown in FIG. 6. As shown in FIG. 6, vibration sensor 15 is specifically placed in counter knife support 6, whereby preferably only the essential frequency range of the cutter structure is being measured.

The vibration frequencies of other structures are not essential for adjusting the knife clearance. In FIGS. 6 and 7 the processes of the measurement of vibrations and adjustment of the knife clearance are schematically shown as block diagrams. Sensor 15 measures the vibrations of counter knife support 6, the vibration level being filtered first and analyzed for frequency range, the purpose being that of removing vibrations which do not belong to the structures, i.e. the frequency range is being 'clearanced'. The sensor information is then fed into a processor, which calculates the mean value in a certain period of time. The calculated mean value of the frequency range will then be compared with the measured means value of the previous period.

The information thus processed is then fed into the controlling or adjusting means, which, on the basis of the control impulses received, alters the temperature of measure section **10, 10*a*, 10*b*** so as to maintain the desired length of the measure section and thus the desired knife clearance. By means of the controller, the measure section can thus be either heated or cooled.

Forces developing in the process of cutting the web can, besides the embodiments described in FIGS. 6 and 7, be measured in several different ways. In the method and apparatus according to the invention, various quantities connected with indirect measurement of forces, or direct measurement of forces acting on the existing structures, can be used as control variables.

An indirect method of measuring cutting forces is, for instance, the measurement of the torque acting on the shaft of drive 4, which can be carried out either directly on the shaft or as measurement of the torque of drive 4. Drive means 4 being an electric motor, the effective cutting force can be measured through the current consumption of drive means 4, as the cutting force is proportional to the torque of the motor and the torque is proportional to the current consumption of the motor.

Another embodiment where indirect measurement of forces is used, is one where vibration sensors are used in defining the vibrating level in the structures and through this defining the effective cutting forces.

In connection with the embodiment according to FIGS. 6 and 7, the adjustment system was described to have a vibration sensor 15 placed in counter knife support 6. As command variable for the thermal apparatus 10–14, can also be used for instance measurement information from force sensors placed in the structures, from torque measuring means between drive means 4 and cutting drum 3, or from the system that measures the current consumption of electric motor. The processing of the command variable in relation to the periods of time is in these embodiments, however, entirely proportional to the time analysis of the vibration sensor.

The outstanding advantage of the adjustment system according to the invention lies in the fact that the knife clearance can be continuously adjusted during operation of the machine.

The temperature of the structure, specifically that of measure section **10, 10*a*, 10*b***, is automatically controlled in such a way that the knife clearance is under all running conditions maintained constant irrespective of the temperature of the web to be cut or of mechanical wear in the knives. According to a preferable embodiment, the system adjusts the knife clearance in such a way that the constant set value is determined both according to the minimum of the occuring cutting forces and according to the optimum quality of the cutting result.

The invention has been described above by way of examples with reference to the figures in the enclosed drawings. The invention is, however, not limited to the embodiments shown in the figures, but the various embodiments may vary within the scope of the spirit of the invention defined by the appended patent claims.

What is claimed is:

1. A method for controlling clearance between knives in a sheet cutter comprising a cutter drum that is provided with a cutting knife that is driven to rotate, and a stationary knife support provided with a counter knife, the clearance between the cutting knife and the counter knife being adjustable, said method comprising the steps of:

(a) detecting at least one of a tangential force resisting movement of the knife past the counter knife and a radial force tending to separate the cutting knife from the counter knife, (b) deriving a signal from the detected force, and (c) employing such signal as a command variable to adjust the clearance between the cutting knife and the counter knife.

2. A method according to claim 1, wherein step (b) comprises generating a signal representative of a mean value of at least one of the tangential force and the radial force over a predetermined interval.

3. A method according to claim 2, wherein step (b) further comprises generating a signal representative of said mean value over a second predetermined interval and generating a difference signal representative of the difference between the mean value over the first-mentioned predetermined interval and the mean value over the second predetermined interval, and step (c) comprises employing the difference signal as the command variable.

4. A method according to claim 1, wherein step (a) comprises detecting vibration of the sheet cutter and generating a signal representative of the amplitude of vibrations due to at least one of the tangential force and the radial force.

5. A method according to claim 4, comprising generating a raw vibration signal representative of the vibration of the sheet cutter and filtering the raw vibration signal to extract therefrom signal componets representative of the tangential force and the radial force.

6. A method according to claim 1, wherein step (b) comprises generating a signal representative of the tengential force by measuring the force required to rotate the cutter drum.

7. A method according to claim 1, wherein the cutter drum is driven to rotate by means of an electric motor, and step (b) comprises generating a signal representative of the tangential force by measuring the current consumption of the electric motor.

8. A method according to claim 1, wherein step (c) comprises adjusting the knife clearance by altering the distance between the cutter drum and the knife support.

9. A method according to claim 6, wherein the cutter drum is supported relative to the knife support by a member that has a finite coefficient of thermal expansion, and step (c) comprises altering the temperature of said member.

10. A method according to claim 8, comprising altering the temperature of said member so as to maintain the clearance constant.

11. A method according to claim 1, comprising controlling the clearance in a manner such as to minimize at least one of the tangential force and the radial force.

12. A method for controlling knife clearance between knives in a sheet cutter employed in the drier section of a paper machine, the sheet cutter comprising a cutter drum that is provided with a cutting knife and is driven to rotate, and a stationary knife support provided with a counter knife, the cutter drum being mounted relative to the knife support by a member having a finite thermal coefficient of expansion, whereby the clearance between the cutting knife and the counter knife is adjustable by controlling the temperature of said member, said method comprising the steps of:

(a) detecting vibration of the sheet cutter, (b) generating a signal representative of the level of vibration that is detected, and (c) employing said signal as a command variable to control the temperature of said member.

13. A method according to claim 12, wherein step (a) comprises detecting vibration of the knife support.

* * * * *